US005740636A

United States Patent [19]

Archard

[11] Patent Number: 5,740,636

[45] Date of Patent: Apr. 21, 1998

[54] WEATHER BLOCK AND VENT

[76] Inventor: William L. Archard, P.O. Box 5, New Paltz, N.Y. 12651

[21] Appl. No.: 48,616

[22] Filed: Apr. 19, 1993

[51] Int. Cl.[6] ..... E04B 7/00

[52] U.S. Cl. ..... 52/94; 52/169.11

[58] Field of Search ..... 52/169.11, 94, 52/95, 96

[56] References Cited

U.S. PATENT DOCUMENTS

| | | | |
|---|---|---|---|
| 4,069,628 | 1/1978 | Kreimer | 52/94 |
| 4,185,433 | 1/1980 | Cantrell | 52/94 X |
| 4,189,878 | 2/1980 | Fitzgerald | 52/94 X |
| 4,581,861 | 4/1986 | Eury | 52/95 |
| 5,007,216 | 4/1991 | Perason | 52/94 |

*Primary Examiner*—Carl D. Friedman
*Assistant Examiner*—Creighton Smith
*Attorney, Agent, or Firm*—Joseph B. Taphorn

[57] ABSTRACT

The thermal efficiency of a building is improved by installing a weather block and vent member across the space between the ends of joists resting on a plate having between them an insulation blanket having a vapor barrier adjacent a ceiling on the bottom of the joists. The member blocks the flow of air towards the end of the vapor barrier and the ceiling and sometimes down past the plate in a wall inside covering and down pass the inside covering and the vapor barrier on the blanket insulation between the wall studs, and redirects it upwards along the rafters. It also blocks the flow of air across the plate, to eliminate the Bernoulli Effect thereat which was operative to suck the out the air between the wall-stud insulation vapor barrier and the wall interior covering. The weather block and vent is field adapted to the parameters of the building and is factory scored for easy field adaptation and so that it can be shipped flat for transportation economies.

6 Claims, 3 Drawing Sheets

WEATHER BLOCK AND VENT

1. FIELD OF THE INVENTION

This invention relates to energy conservation, and more particularly to buildings more efficiently utilizing insulation barriers and to a product for readily constructing such buildings.

2. BACKGROUND OF THE INVENTION

Houses and other buildings are already being constructed using thermal insulation layers to reduce the transfer, both in and out, of heat between the interior of a building and its environment. For example, an insulation layer of fiberglass is inserted between the joists or horizontal beams holding up a ceiling on a room below a ventilated attic exposed to outside temperatures. An insulation layer is also inserted between the studs of an wall separating a room from the outside environment. These insulation layers prevent the outflow of heat from the room in the winter and consequent loading of the furnace, and the inflow of heat in the summer and the consequent burdening of the air conditioner.

The joists for a room are normally horizontal beams and have ends resting on plates on the tops of the walls. The plates are boards which are secured to the upper ends of the studs and serve to hold them in place. In addition to supporting the ends of the joists, the plates also support the ends of rafters that normally are diagonal beams which mount the roof of a building and which overhang the the outside walls of the building to form eaves. The joists and the rafters are generally equally spaced with respect to other joists and rafters and in sets that have their ends at the plates juxtaposed and define an air entrance between their ends into the attic. (Sometimes a joist and rafter, particularly for large buildings, are preconstructed as a truss in which the rafter overlies the joist and rests at its end thereon, the ends of the joists resting directly on the plate. In other constructions such as for cathedral ceilings, the joists may be completely eliminated and blanket insulation occupies bottom space between the rafters.) The overhang of the rafters or eave keeps rain, ice, snow, and sun a distance from the outside wall of a building while still accommodating the upflow of air therethrough from vents placed in a soffit forming the bottom of the eaves or rafter overhang. Vents at the ridge lines formed by meeting rafters pass attic air to the environment. In so doing the ridge line exhausts hot air from the attic in the summer to reduce the thermal gradient between the room temperature and the attic temperature to render the air conditioning load less. In the winter the ridge line vents exhaust air to keep the thermal insulation dry and more effective as an insulator.

Blanket insulation normally consists of a thick layer of thermal insulating material such as fiberglass on a thin vapor barrier. The layer is of a width to fill fully the space between adjacent joists or rafters or studs. The vapor barrier extends beyond the sides of the layer and provides a means for stapling the blanket insulation to the joists or studs or studs.

Sometimes the vapor barrier side extensions are nailed or stapled to the bottom surfaces of the joists or rafters or the inside surfaces of the studs; however, this covers up these surfaces, making mounting of the ceiling or wall inside coverings of sheetrock or the like more difficult because the surfaces are harder to locate. Nailing to these surfaces results in the vapor barrier resting on or next to the ceiling or wall coverings, but it has been found that this contact does not prevent the movement of wind driven outside air of atmospheric temperature between the ceiling covering and the vapor barrier to short-circuit the thermal barrier of the blanket insulation and also to push the atmospheric temperature air through electrical outlets and like openings (such as light fixtures and other ceiling receptacles) direcity into the room to additionally load heating and cooling systems.

Other times the vapor barrier side extensions are bent at right angles with respect to the rest of the blanket insulation and nailed to the inside of the joists, rafters or studs and so that the vapor barrier is generally in spaced relation to the sheetrock or other material forming the ceiling or interior covering of the wall; this leaves the bottom or inside surfaces of the joists, rafters, or studs exposed and allows for easier sheetrocking or the like.

Unfortunately, the spacing between the vapor barrier and the ceiling or interior covering of the outside wall facilitates increased flow of wind driven outside air of atmospheric temperature between the ceiling covering and the vapor barrier to short-circuit extensively the thermal barrier of the blanket insulation and also to push extra atmospheric temperature air through electrical outlets and like openings directly into the room to additionally further load heating and cooling systems.

The adverse effects of atmospheric air getting between the blanket insulation and the ceiling or wall inside covering are especially large during winter when wind velocities are highest and when the cold air freezes up plumbing pipes in a wall or above a ceiling. Wood and sheetrock ceiling and wall coverings are never perfectly airtight and with electrical outlets, light fixtures and the like, let air into and out of a room. Moreover over time, air sabatages the integrity of the insulation. Sky lights in cathedral ceilings have long been a big source of heat loss from unwanted air currents.

3. PRIOR ART

The prior art includes the use of trough vents between rafters to reduce air flow into and through the space between the ceiling and the insulation barrier. The trough vents admit air into the attic or along the underside of the roof while serving as a stop against which the blanket insulation may be jammed in an effort to force the end of its vapor barrier tightly against the ceiling or the plate to prevent the entrance of air between the vapor barrier and the ceiling or plate. Unfortunately jamming installation of blanket insulation has not been overly effective in preventing undesirable air flow.

The trough vents do pass air (for among other purposes such as ventilating the attic and/or drying insulation wet from dewpoint action) along the rafters and under the roof thereon to preclude melting during the winter of snow thereon while snow over the eaves does not melt and forms a dam allowing the buildup of water that leaks through the roof's shingles into the house and that damages gutters by overload.

SUMMARY OF THE INVENTION

Accordingly, it is an object of this invention to reduce atmospheric air entrance between the vapor barrier of an insulating thermal blanket and the ceiling or wall interior covering.

Another object of the invention is still to allow adequate air flow to the attic space or below the roof to the ridge vents.

A more general object of the invention is to maximize the operating efficiency of thermal blanket insulation.

A still more general object of the invention is to reduce the energy spent in maintaining buildings at selected temperatures in the winter and in the summer.

A yet still more general object of the invention is to reduce the contributions that heating and cooling buildings make to warming the earth.

An additional object of the invention is to continue to prevent roof and gutter damage.

A further object of the invention is to accomplish the above in a simple and cost effective way.

The above objects of the invention are accomplished through the installation during construction of a building of a basic product that is easily mounted by a carpenter. The basic product consists of a flat piece of weather-proofed corrugated board or the like such as plastic that is scored on a series of horizontal lines across its bottom portion and on two vertical lines on each side to enable portions of it to be readily bent in advantageous directions and that is readily cut at the building site to fit the particular construction being undertaken. The adapted product installed extends across the bottom of the space between a pair of adjacent rafters and bends forward at an intermediate point to extend upwards a trough between the rafters.

The product is field adapted to a particular building by cutting along a selected horizontal line to define upper and lower or bottom portions. The upper portion has its portions outwards of the interior side lines bent upwards to form a trough. Then the portions of the upper portion bent upwards are bent outwards at the exterior side lines for nailing or stapling to the tops of rafters. Then the product is placed between two rafters and so that the horizontal line that was cut a portion lies above the outer edge of the outside wall, and the upper portion nailed to the rafters.

Then the bottom portion of the product is bent down at the horizontal line that was cut and nailed or stapled to the plate, the sides exterior of the interior lines having been bent upwards for nailing or stapling to the adjacent sides of the adjacent rafters.

This construction prevents air blowing in from under the eaves from entering between the insulation-blanket vapor barrier and the ceiling, and between the plate and wall inside covering and down past the wall vapor barrier or from flowing past the plate to suck by the Venturi or Bernouli Effect air from the spacing between wall-insulation vapor barrier and -interior wall covering and which is replaced by outside air entering from the bottom. Such action of course short circuits the thermal barrier effect of the insulation blanket. In the winter it also directly replaces warm air in a room with cold atmospheric air; in the summer it also directly replaces cold air in a room with hot atmospheric air.

BRIEF DESCRIPTION OF VIEWS OF THE INVENTION DRAWINGS

These and other objects features and advantages of the invention will become apparent from a reading of the following description, when considered with the appended drawings setting forth a preferred embodiment of the invention, wherein.

DETAILED DESCRIPTION OF A PREFERRED EMBODIMENT OF THE INVENTION

Figure 1:
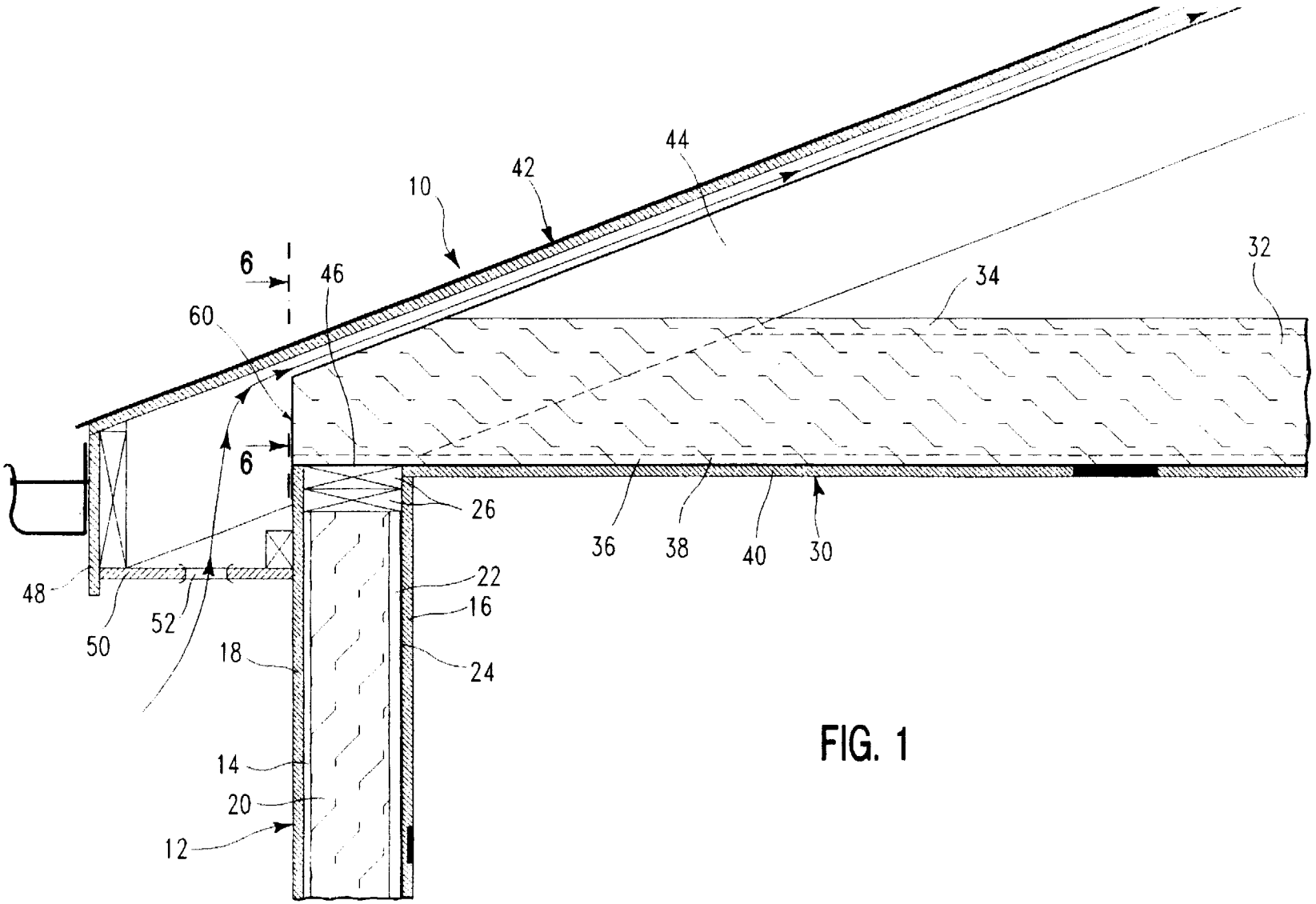
FIG. 1 is a diagrammatic cross-sectional view of a portion of a house incorporating the invention.

Referring now to the drawings and more particularly to FIG. 1 thereof, a house generally indicated by the numeral 10, is shown as having an outside wall generally indicated by the numeral 12. The wall 12 includes a series of equally spaced studs 14 having an interior covering 16 of sheet rock or the like, and an exterior wall covering 18 of wall board or the like. Filling in the space between each pair of adjacent studs 14 is a blanket of thermal insulation 20 having a vapor barrier 22. The vapor barrier 22 secured as by gluing to one side of the blanket extends beyond the sides of the blanket to form a flange 24 that is bent away from the blanket 20 and used to staple the blanket to the sides of the studs and so as to form an air space between the vapor barrier 22 and the interior wall covering 16. The upper ends of the studs 14 are held in place by a pair of plates 26 constituting the upper end of the wall 12 and supporting the ceiling and roof superstructures of the house.

The ceiling superstructure generally indicated by the numeral 30 includes a series of equally spaced joists or horizontal beams 32 resting on their one ends on the wall top plate 26 and secured thereto as by nailing generally above corresponding studs 14. The space between each pair of adjacent joists 32 is filled with a blanket of thermal insulation 34 of the same or greater thickness than the blanket 20 in the wall 12. A vapor barrier 36 extends beyond the sides of the blanket 34 and is bent away from the blanket to form a flange 38 used to staple it to the insides of the joists and forms an air space between the vapor barrier 36 and a ceiling covering 40 of sheetrock or the like.

The roof superstructure generally indicated by the numeral 42 includes a series of equally spaced rafters or diagonal beams 44 resting near their lower ends via a notch cut 46 in each on the top plate 26 and secured thereto as by nailing juxtaposed to a corresponding joist 32. The rafters 44 overhang the wall 12 to form an eave including a facia 48 closing off the end of the rafters and a soffit 50 closing off the bottom. The soffit 50 is provided with screened vents 52 admitting outside air into the eave wherefrom it formerly passed up and directly over the top plate 26 between the joists to ventilate the attic formed between the ceiling and roof superstructures.

Figure 2:
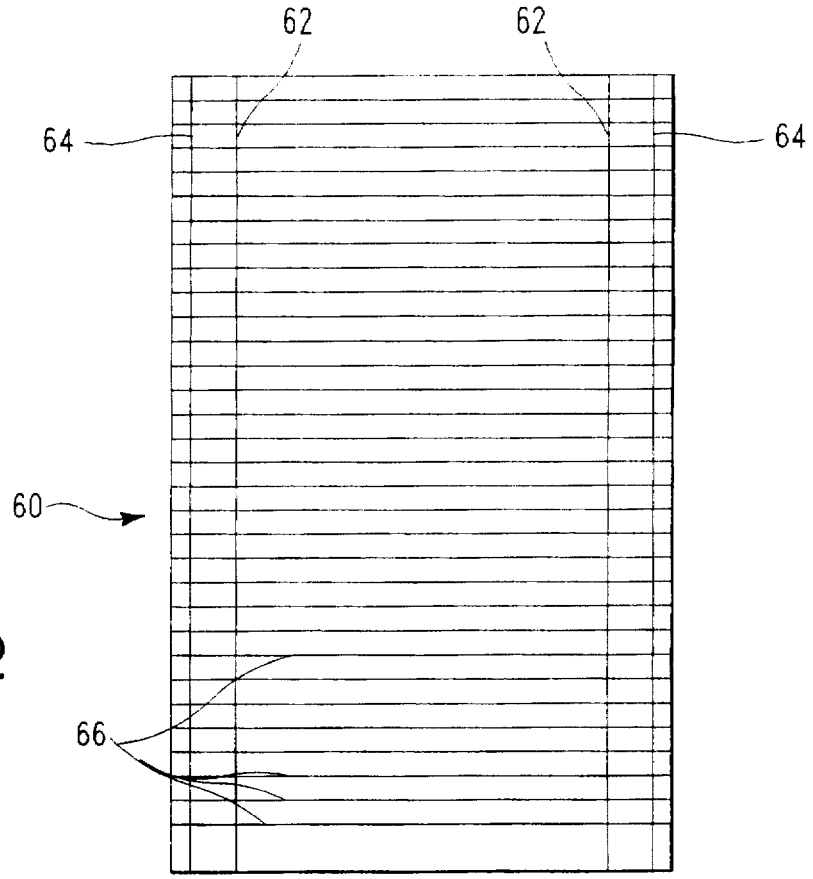
FIG. 2 is plan view of a weather block and vent scored with horizontal and vertical lines for on-site adaptation and ready installation during construction of the house of FIG. 1.
Figure 3:
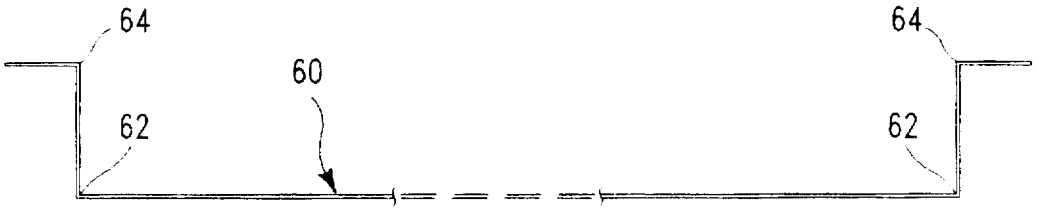
FIG. 3 is a diagrammatic cross-sectional view of the upper portion of the weather block and vent of FIG. 2 bent to define a trough between the tops of adjacent rafters.
Figure 4:
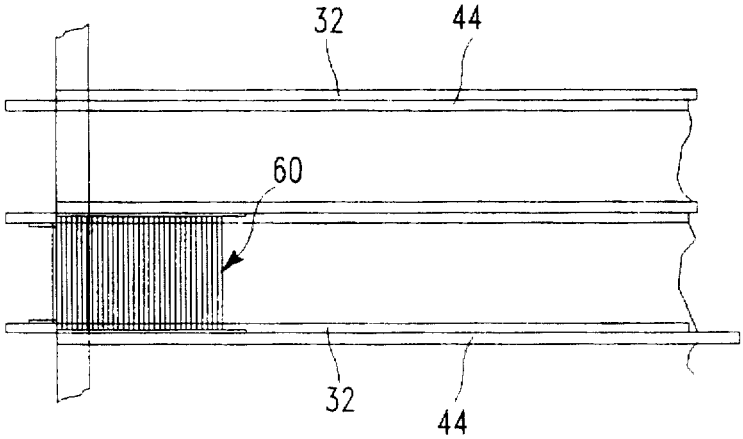
FIG. 4 is a top view showing diagrammatically a bent weather block and vent installed between a pair of associated adjacent rafters and over joists.
Figure 5:
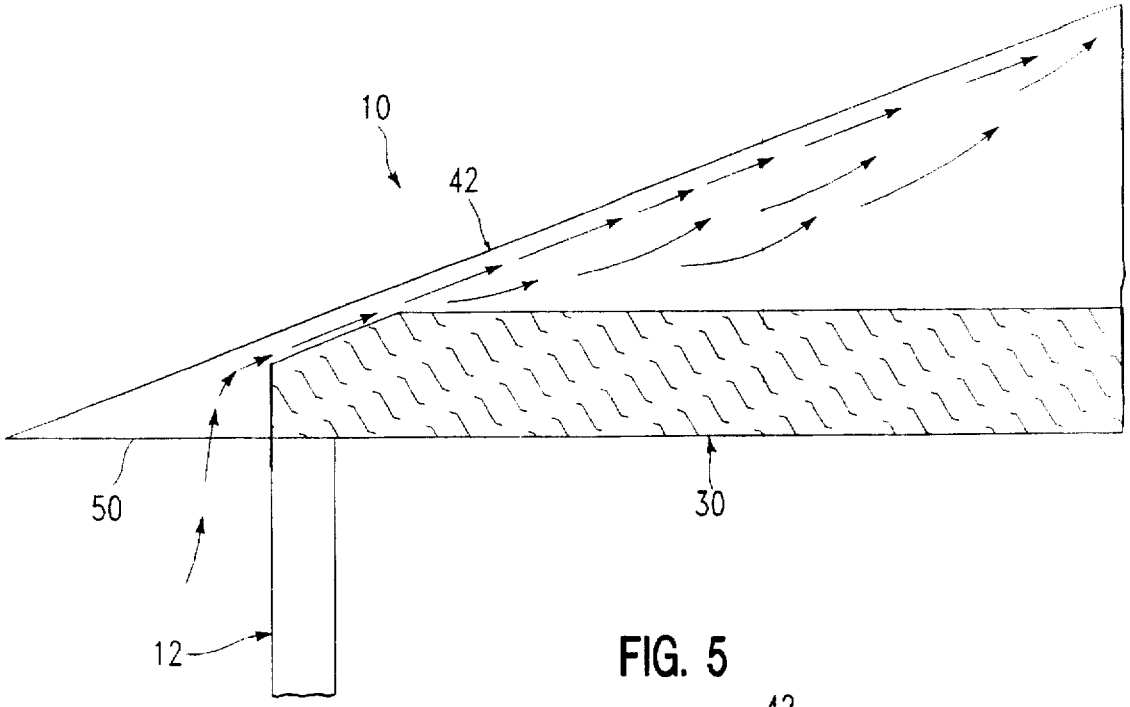
FIG. 5 is a representation showing diagrammatically on the left side air flow according to the invention, and on the right side air flow in preexisting constructions.
Figure 6:
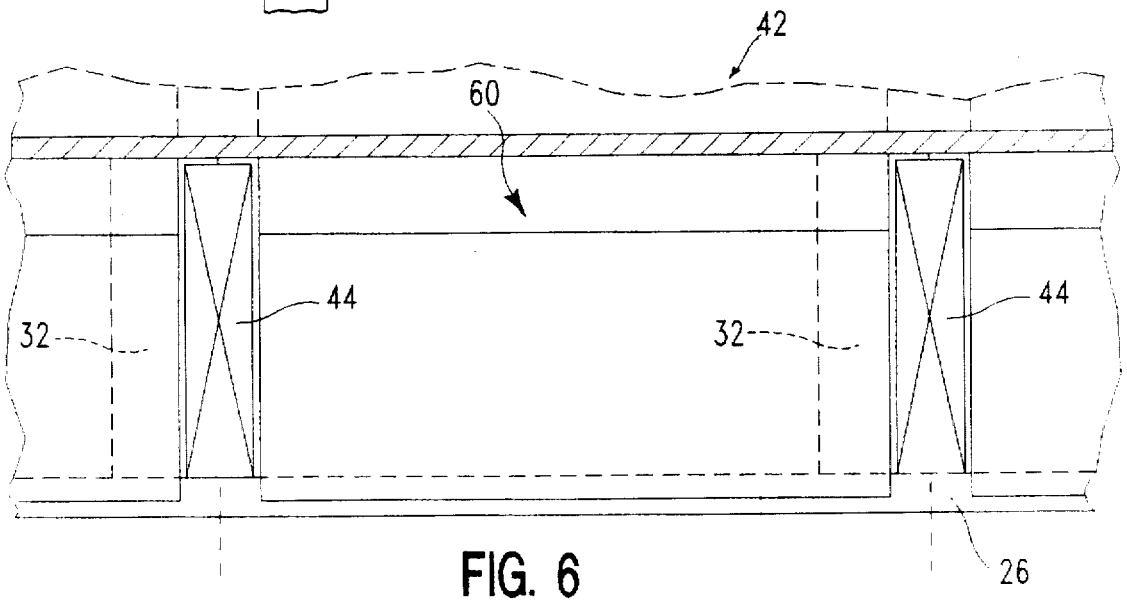
FIG. 6 is a diagrammatic cross-sectional view looking towards the house of FIG. 1 and taken at the wall's outside edge.
Figure 7:
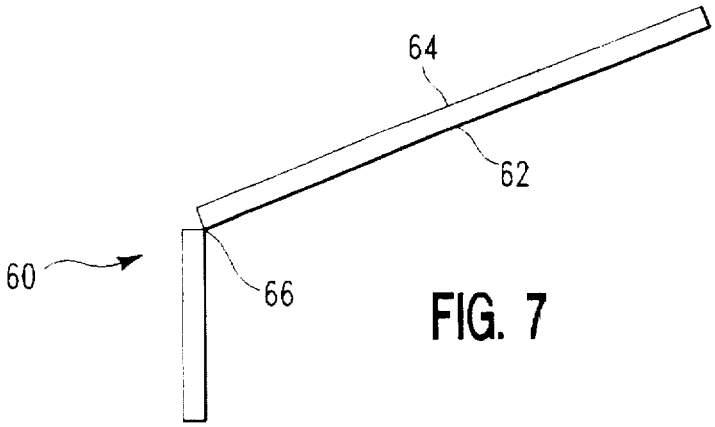
FIG. 7 is a diagrammatic side view of the weather block and vent of FIG. 2 bent and cut for installation.

In between each set of juxtaposed adjacent joists 32 and rafters 44 is secured in place, normally before the roof sheeting is applied to the rafters, a bent work block and vent member generally indicated by the numeral 60. Preferably it is made of a material such as Michaelman Coated Corrugated Board, but other materials such as weather-proofed cardboard material may be employed. It is shown as it is shipped and before it was bent at the building site, in FIG. 2.

Along each side the member 60 is scored with an interior line 62 and an exterior line 64. The interior scored lines 62 are for facilitating folding the portions of the weather block and vent member 60 exterior of them upwards, and the exterior scored lines 64 for folding the portions exterior of them outwards. The portion of the weather block and vent member between the interior scored lines 62 constitutes the bottom of a trough formed when the portions outward thereof are folded or bent upwards, and the depth of the trough is defined by the distance between the interior and exterior scored lines 62 and 64 when the portions outward of the exterior scored lines 64 are bent outwards from the adjacent portions interior thereof.

If greater trough depth is desired at an installation, no folding need be made along the exterior scored lines 64 and instead the portions outward thereof nailed directly to the insides of the rafters to locate the bottom of the trough further downwards.

The weather block and vent members are factory scored to typical rafter and joist separations such as result from spacing on 16 inch or 24 inch centers. If a non-typical separation obtains, it is first measured. Then that distance is laid out on the member from either interior side line and a new line scored therealong with a utility knife. A second line outwards of the new line is scored parallel thereto to define the depth of the trough. Some bending is now done on the new lines and the weather block and vent mounted as heretofore, any extra portions of the member being allowed to hang in the space on the other side of the rafter.

The bottom portion of the weather block member is scored with a plurality of equally spaced horizontal lines 66. A horizontal line 66 having a sufficient portion of the member below it to cover the space below the trough and to provide a surface for nailing to the plate 26 (as determined by previous experimentation), is cut through from interior lines 62 to the outside edges of the member 60. This cut facilitates bending of the bottom portion of the member downwards to close off air flow through the bottom portion of the space between the joist end and the rafter with an adjacent joist after the upper portion constituting the trough is laid between the two adjacent rafters. After the parts of the weather block and vent member 60 are properly positioned with respect to adjacent joists and rafters of each set, the portions of the member trough outwards of the exterior scored lines 64 are nailed or otherwise secured to the top of the rafters and the center portion of the member bottom below the cut scored line 66 is nailed or otherwise secured to the plates 26 or other portions of the outside wall 12 while the portions outwards of the interior scored lines 62 are nailed to the overhangs of the adjacent rafters of the set. Caulking and/or duck tape may be utilized to maximize the seal between the building and the formerly flat weather block and vent member 60.

Air entering the attic via the soffit vents 52 is now prevented from flowing directly over the plates 26 and into inbetween the ceiling insulation blanket vapor barrier 36 and the ceiling interior covering 40 and sometimes into inbetween the plates 26 and the wall inside covering. At other times, elimination of this flow prevents the introduction of the Bernoulli Effect immediately above the plates 26 and hence eliminates the suction by it of air from between the wall insulation blanket vapor barrier 22 and the wall inside covering. Thus heat loss in winter from and heat entrance in summer into the house is reduced and the insulation blanket allowed to provide its full thermal barrier efficiencies.

It can be seen that applicant has provided a total weather block to the entrance of wind driven atmospheric air. Moreover, no longer can these elements destroy significantly the integrity of the insulation. When this product is properly installed, which is easy and the seams are caulked and/or taped, there is no way for air to adversely affect the insulation efficiency of a house. Furthermore, the roof will not leak due to ice formation.

While there has been shown and described a preferred embodiment of the invention, it will be evident to persons skilled in the art that principals of the invention may be used in other embodiments. It is intended therefor to be limited only by the scope or spirit of the appended claims.

What is claimed is:

1. In a building having a plate, adjacent beams each resting at their one ends on the plate, a ceiling covering on the underside of the beams, a thermal insulation layer between said beams and having a vapor barrier adjacent said ceiling covering, and a weather block and vent member extending between the bottom portions of the said beams at said plate to block atmospheric air from flowing towards the end of the vapor barrier, wherein the beams are joists and a corresponding set of rafters rest on said plate juxtaposed to the joists, and the weather block and vent member extends upwards between the rafters to form a trough redirecting blocked air upwards oven the insulation layer, wherein the weather block and vent member trough is formed by a horizontal-in-crosssection portion having raised sides bent upwardly along side score lines and extending along the sides of the adjacent rafters and which raised sides have laterally outward directed portions which are secured to the upper surfaces of the rafters.

2. A building according to claim 1, wherein the weather block and vent member extends downward over a portion of the plate, having been bent downward at one of a plurality of horizontal score lines thereon.

3. A building according to claim 1, wherein the plate is the upper part of a wall and rests on spaced studs bearing a wall interior covering and a blanket of thermal insulation between them and so that a vapor barrier on the face of the blanket is facing the covering, the blocked air flow also eliminating the Bernoulli Effect sucking air up out of the space between the vapor barrier and wall interior covering.

4. A building according to claim 1, wherein the rafters extend over the plate to form an cave having a soffit, and there is a vent in the soffit to admit air into the caves and over the weather block.

5. A building according to claim 4, wherein the joists and the rafters help define an attic, and the attic is vented in its upper portion to the atmosphere.

6. A weather block and vent member for directing the flow of air between beams away from the end of a vapor barrier of a thermal insulating blanket, comprising a flat generally rectangular element of weather-proof corrugated board of the like, a scored line along each side of the member for bending the side upwards, and a scored line across the bottom of said member for bending the portion below it downwards, wherein there are a plurality of scored lines across the bottom of said member, any one of which may be used to bend the portion below it downwards, wherein the block and vent member along the scored lines across the bottom is easily cuttable through the sides to be bent upwards to facilitate the downward bending, wherein there is a second scored line along each side of the member outside of the other scored line for bending outwards a portion of the side bent upwards.

* * * * *